US012060793B2

(12) United States Patent
Lanning et al.

(10) Patent No.: US 12,060,793 B2
(45) Date of Patent: Aug. 13, 2024

(54) GEOSTEERING IN A LATERAL FORMATION

(71) Applicant: INTREPID RSS, LLC, Midland, TX (US)

(72) Inventors: Curtis Lanning, Montgomery, TX (US); Robert Kelly Owen, Missouri City, TX (US); Daniel Seutter, Richmond, TX (US)

(73) Assignee: INTREPID RSS, LLC, Midland, TX (US)

( * ) Notice: Subject to any disclaimer, the term of this patent is extended or adjusted under 35 U.S.C. 154(b) by 346 days.

(21) Appl. No.: 17/297,729

(22) PCT Filed: Dec. 18, 2019

(86) PCT No.: PCT/US2019/067225
§ 371 (c)(1),
(2) Date: May 27, 2021

(87) PCT Pub. No.: WO2020/132097
PCT Pub. Date: Jun. 25, 2020

(65) Prior Publication Data

US 2022/0025710 A1 Jan. 27, 2022

Related U.S. Application Data

(60) Provisional application No. 62/782,039, filed on Dec. 19, 2018.

(51) Int. Cl.
*E21B 7/10* (2006.01)
*E21B 7/04* (2006.01)
(Continued)

(52) U.S. Cl.
CPC ..... *E21B 7/10* (2013.01); *E21B 7/04* (2013.01); *E21B 47/022* (2013.01); *E21B 47/09* (2013.01)

(58) Field of Classification Search
CPC ..... E21B 7/04; E21B 7/06; E21B 7/10; E21B 47/022; E21B 47/024; E21B 49/00
See application file for complete search history.

(56) References Cited

U.S. PATENT DOCUMENTS 9,157,314 B1 * 10/2015 Pogrebinsky ..... E21B 7/06
2009/0095530 A1 4/2009 Waters et al.
(Continued)

FOREIGN PATENT DOCUMENTS

WO 2018144169 8/2018

OTHER PUBLICATIONS

PCT International Search Report and Written Opinion mailed Mar. 17, 2020 in corresponding PCT Application No. PCT/US2019/067225, pp. 1-8.

*Primary Examiner* — Christopher J Sebesta
*Assistant Examiner* — Lamia Quaim
(74) *Attorney, Agent, or Firm* — Jackson Walker LLP; Christopher J. Rourk

(57) ABSTRACT

Disclosed is a downhole tool and method suitable for geosteering within a lateral formation. The downhole tool includes a gamma sensor for monitoring gamma radiation within the lateral formation. The method provides for monitoring of the location of the drill bit or a RSS within a borehole and correcting the angle of inclination to maintain the drill bit or RSS within the target zone of the lateral formation.

17 Claims, 2 Drawing Sheets

(51) Int. Cl.
*E21B 47/022* (2012.01)
*E21B 47/09* (2012.01)

(56) References Cited

U.S. PATENT DOCUMENTS

| | | | | |
|---|---|---|---|---|
| 2010/0324825 | A1 | 12/2010 | Detournay | |
| 2012/0046868 | A1 | 2/2012 | Tchakarov et al. | |
| 2013/0161096 | A1 | 6/2013 | Benson et al. | |
| 2013/0270009 | A1 | 10/2013 | Logan et al. | |
| 2015/0218934 | A1 | 8/2015 | Turner | |
| 2016/0123134 | A1 | 5/2016 | Viens | |
| 2016/0201449 | A1 | 7/2016 | Dirksen et al. | |
| 2018/0023347 | A1* | 1/2018 | Bleeker | E21B 7/062 175/57 |

* cited by examiner

GEOSTEERING IN A LATERAL FORMATION

PRIORITY CLAIM

This Application claims priority and incorporates fully the disclosure of U.S. Provisional Application Ser. No. 62/782,039 filed Dec. 19, 2018, titled "GEOSTEERING IN A LATERAL FORMATION".

BACKGROUND

When drilling a lateral borehole, the operator must maintain directional drilling within the target production zone. Additionally, the drilling operation must avoid repeated upward and downward changes in borehole direction. Significant downward deflection of the borehole will limit or preclude production from regions of the production zone. Repeated changes in upward and downward deflections will increase completions costs. Current geosteering techniques suffer from delays necessary to evaluate downhole data and frequently result in portions of the lateral borehole located outside of the production zone.

Disclosed herein is an improved downhole tool configuration and an improved method for controlling directional drilling a manner to maintain the lateral borehole within the production zone. Additionally, the improved tool configuration and method precludes "porpoising" of the drill bit through the production zone.

SUMMARY

Disclosed is a downhole tool. The downhole tool includes a drill bit carried by a bit box, a rotary steerable system secured directly or indirectly to said bit box and a MWD sensor (direction and inclination measurement) located between about adjacent to the drill bit and about ten feet from said drill bit. The tool also includes a gamma sensor positioned between about adjacent to the drill bit and about thirty feet from said drill bit.

Also disclosed is a method for drilling a lateral borehole. The method includes the steps of:

- drilling a first borehole from the surface and identifying a target zone for a lateral borehole;
- initiating drilling of said lateral borehole within said target zone by placing a downhole tool within said first borehole and drilling said lateral borehole at a first angular inclination direction;
- said downhole tool comprising a drill bit carried by a bit box, a rotary steerable system secured directly or indirectly to said bit box and a gamma sensor, said rotary steerable system including a memory system pre-programmed with a plurality of angular correction values and pre-programmed with a plurality of multiplier values;
- selecting a first angular correction value from the plurality of pre-programmed angular correction values;
- using said gamma sensor to obtain gamma radiation values, evaluate the gamma radiation in the area of said target zone;
- using the gamma radiation values, identify a first formation above the target zone, said first formation above the target zone having a first bottom, a first center and first top and identify a second formation below the target zone, said second formation having a second bottom, a second center and a second top;
- associate one of said multiplier values with each of said target zone, first bottom, first center, first top, second bottom, second center and second top;
- monitoring the location of the drill bit or the rotary steerable system during drilling operations using the gamma sensor and determining a monitored position of the drill bit or the rotatory steerable system;
- identify the location of the drill bit or the rotary steerable system as one of the target zone, first bottom, first center, first top, second bottom, second center and second top;
- determining a gamma target inclination correction value using the identified location of the drill bit or the rotary steerable system wherein the gamma target inclination correction value is the product of the first angular correction value and the multiplier value associated with the identified location of the drill bit or rotary steerable system;
- continue drilling said lateral borehole by applying the gamma target inclination correction value to the first angular inclination direction of the drill bit or rotary steerable system or the current angular inclination direction.

DETAILED DESCRIPTION

Figure 1:
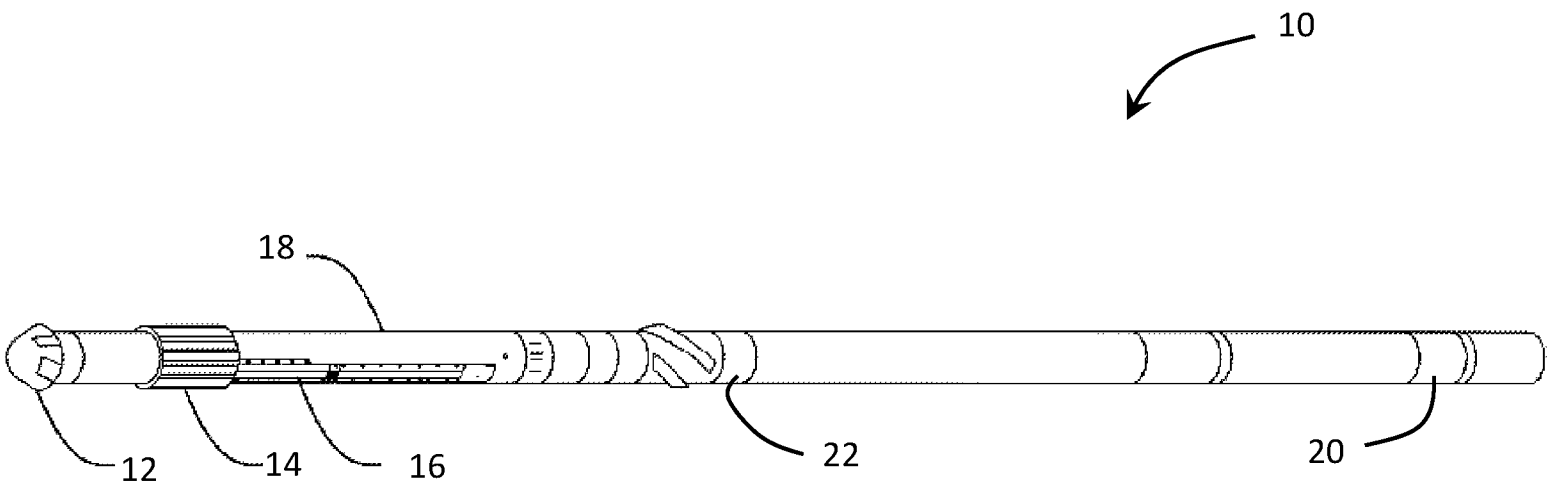
FIG. 1 depicts one of the improved configurations of a downhole tool suitable for practicing the disclosed method of lateral drilling.

With reference to FIG. 1, a downhole tool 10 configured to provide improved control over lateral drilling operations includes a drill bit 12 secured, directly or indirectly, by a bit box 14 to a rotary steerable system (RSS) 16. Additionally, downhole tool 10 optionally includes a measurement while drilling sensor (MWD) 18 configured to monitor the direction and inclination of drill bit 12 or RSS 16. MWD 18 may be located immediately adjacent to drill bit 12 or up to about ten feet from drill bit 12. Alternatively, MWD 18 may be separate from downhole tool 10. When MWD 18 is included as part of downhole tool 10, it will be provided with a communication mechanism such as a wired connection or electromagnetic (EM) connection to RSS 16.

Downhole tool 10 also includes a gamma radiation sensor (gamma sensor) 22. Gamma sensor 22 may be positioned on downhole tool 10 anywhere from immediately adjacent to drill bit 12 to about thirty feet from drill bit 12. Typically, gamma sensor 22 is carried by or incorporated into RSS 16. Typically, gamma sensor 22 is found no more than about ten feet from drill bit 12. Alternatively, gamma sensor 22 may be incorporated into MWD 18 or provided as a separate component on downhole tool 10. One suitable gamma sensor 22 is an azimuthal gamma sensor 22.

In one configuration of downhole tool 10, MWD 18 is located about three feet to about ten feet from drill bit 12 with gamma sensor 22 located between drill bit 12 and MWD 18. Alternatively, MWD 18 is located about three feet to about ten feet from drill bit 12 with gamma sensor 22 located uphole of MWD 18 but no more than ten feet from drill bit 12.

In most instances, control of directional drilling will be managed by circuitry incorporated into downhole tool 10.

Typically, downhole tool 10 includes a programmable memory, not shown, and a proportional-integral-derivative controller (PID), not shown. However, other similar devices such as but not limited to a programmable logic controller (PLC) can be used to manage operations of downhole tool 10. Alternatively, the programmable memory and controller may be a single integral system. The following disclosure discusses management of downhole tool 10 with reference to a PID which has been incorporated into the RSS; however, other configurations, such as but not limited to a PLC, will also operate satisfactorily.

In order to properly manage drilling operations, the PID is pre-programmed with a series of angular correction values and a series of multiplier values. During drilling operations, use of the currently selected stored angular correction value and a multiplier value will provide RSS 16 with a gamma target inclination correction value to be applied to the current angular inclination direction. Thus, the multiplication of the selected stored angular correction value by the multiplier value produces a change in the inclination of drill bit 12 in either an upward or a downward direction as described in more detail below. Additionally, the PID will be initially preprogrammed with initial target inclination and azimuth values. While the inclination target will be adjusted as described below, the azimuth target will be maintained throughout the drilling process automatically by conventional RSS steering control. The resultant steering decision from the adjusted target inclination and the preprogrammed azimuth will automatically adjust bias to control the azimuth if a significant error occurs, for example, when azimuth error becomes greater than inclination error due to a left pushing formation.

While the preprogrammed angular correction values may be any desired values, typical angular correction values will be 0.15°, 0.25°, 0.50° and 0.75°; however, other values may be used. Typical multiplier values will be 0, 1, 2, 3, −1, −2, and −3. The product of the selected angular correction value and the multiplier value will provide the gamma target inclination correction value. Thus, the gamma target inclination correction value alters the angular inclination direction of drill bit 12 or RSS 16. For example, if the angular correction value is 0.25° and the multiplier value is −2, the gamma target inclination correction value changes the drilling direction downward by 0.50°, i.e. −0.50° from the initial target inclination value or the current angular inclination direction if the drilling direction had been previously adjusted.

Also, included as part of downhole tool 10 is a communication tool 20. Communication tool 20 may be part of RSS 16 or MWD 18. Any convenient communication tool 20 capable of transmitting and receiving data from the surface will be suitable for inclusion in downhole tool 10. Alternatively, communication tool 20 may be included as part of the drill string carrying downhole tool 10. Communication tool 20 will be in communication with the PID and RSS 16.

The following methods for drilling a lateral borehole will be discussed with reference to downhole tool 10 described above. Each method begins with the drilling of a conventional borehole from the surface to the desired lateral kick-off location. Commonly, gamma readings will be taken during drilling of the vertical borehole. As such, the vertical borehole will commonly extend beyond the kick-off location to permit complete gamma mapping of the target zone and regions above and below the target zone. Alternatively, the gamma mapping may be carried out using an offset vertical well. Following identification of target zone 30 and kick-off of the lateral borehole, downhole tool 10 will guide drilling of the lateral borehole through target zone 30. During drilling of the lateral borehole, the method provides automated closed loop steering control of downhole 10. For the purposes of this method, the location of RSS 16 or drill bit 12 may be determined using data from gamma sensor 22.

Monitoring of either RSS 16 or drill bit 12 will work equally well in the present method. Generally, only one of drill bit 12 or RSS 16 will be monitored. In the methods described herein, monitoring of either drill bit 12 or RSS 16 will perform satisfactorily. During performance of the disclosed method, the method will consistently monitor the selected reference point, i.e. either drill bit 12 or RSS 16.

Figure 2:
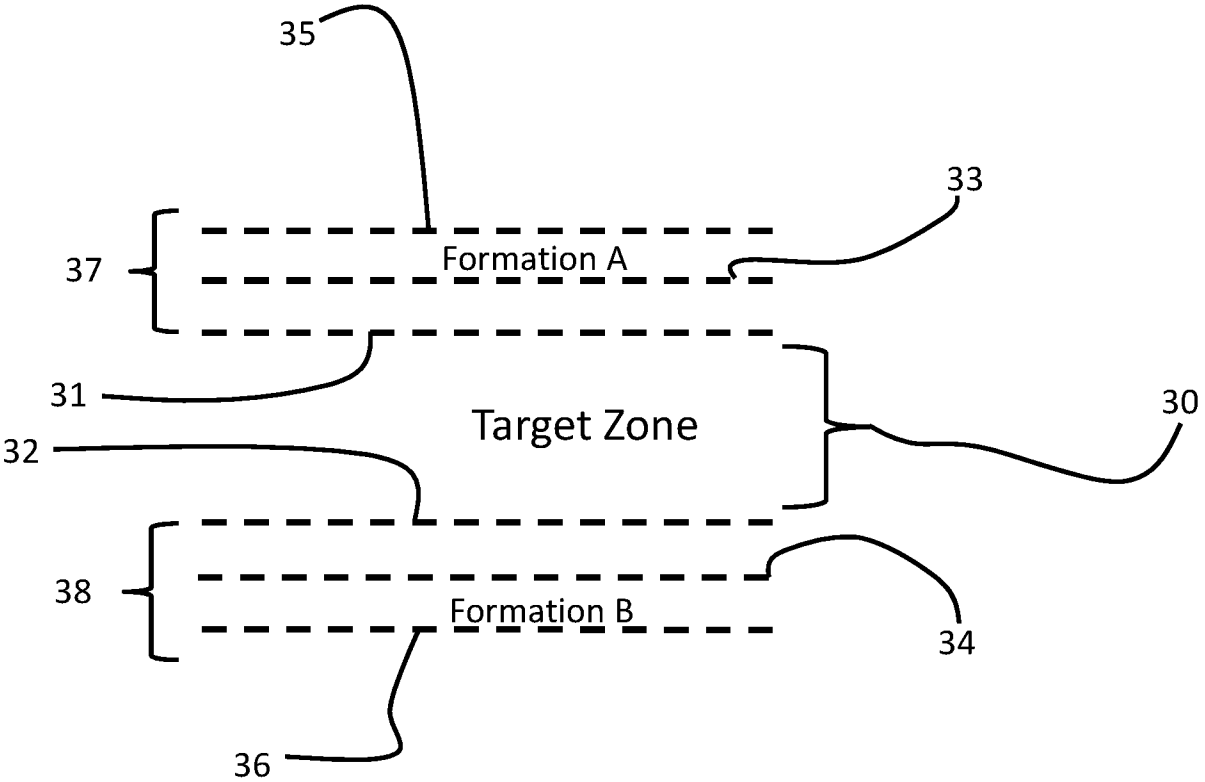
FIG. 2 depicts a subterranean formation including a target zone and upper and lower boundaries outside of the target zone.

The target zone 30 is identified using gamma sensor 22. With reference to FIG. 2, Data from gamma sensor 22 establishes the upper and lower boundaries of target zone 30. Additionally, gamma sensor 22 determines the scope of the regions above and below target zone 30. The region above target zone 30 is referred to herein as Formation A and the region below target zone 30 is referred to herein as Formation B. For reference purposes in FIG. 2, Formation A is identified as element 37 and Formation B as element 38; however, FIG. 2 is non-limiting as to the dimensions of Formations A and B. For purposes of selecting the angular correction value and multiplier, three locations within Formation A and three locations within Formation B are identified. Thus, Formation A has a bottom 31, a center 33 and a top 35. Likewise, Formation B has a top 32, a center 34 and a bottom 36.

Using predetermined target inclination and azimuthal values, drilling of the lateral borehole continues. As drilling progresses, gamma sensor 22 continuously monitors gamma radiation, gamma radiation values are referred to herein as gamma counts, to determine the relative location of drill bit 12 or RSS 16 within target zone 30. Data from gamma sensor 22 is transmitted to downhole tool 10. The PID portion of downhole tool 10 interprets the data, calculates the gamma target inclination correction value and directs RSS 16 to adjust the drilling inclination direction to maintain drill bit 12 or RSS 16 within the target zone. Typically, inclination adjustments take place about every ten seconds to about every thirty seconds. More typically, inclination adjustments occur every 15 seconds to 25 seconds. In some embodiments, circuitry in the RSS 16, such as the PID, is also programmed to receive, interpret and apply data from gamma sensor 22 every 20 seconds. Using the disclosed method, lateral drilling operations using rotary steerable system 10 provides continuous adjustment of the inclination of drill bit 12 in response to changes in gamma radiation. The method provides the ability to maintain drilling of the lateral borehole within a plus/minus range of about 0.75° to about 2.25° of the gamma target inclination value.

The predetermined inclination value will typically be 90° from the generally vertical borehole; however, other target inclination values may be used to accommodate the configuration of target zone 30. For the purposes of explaining the continuous inclination correction capabilities of downhole tool 10, the following discussion utilizes an initial target inclination of 90° from the vertical borehole.

As drilling continues, gamma sensor 22 continuously monitors the location of drill bit 12 or RSS 16. By monitoring gamma radiation values, gamma sensor 22 will be able to determine the proximity of drill bit 12 or RSS 16 to the previously identified locations within Formation A, Formation B or target zone 30. In one embodiment, the locations within target zone 30, Formation A and Formation B are used to determine the multiplier values of: 0, 1, 2, 3, −1, −2, and −3. Multiplier value 0 corresponds to target zone 30. Multiplier values −1, −2 and −3 correspond to Formation A locations bottom 31, center 33 and top 35 respectively. Multiplier values 1, 2 and 3 correspond to Formation B locations top 32, center 34 and bottom 36 respectively.

Although described herein with reference to three multiplier values for each of Formation A and Formation B, the present method will also function with only one or two multiplier values corresponding to one or two locations in each of Formation A and Formation B. When using one or two reference locations in each Formation, each reference location will be assigned a multiplier value as described herein with regard to the method using three reference locations (top, center, bottom) in each Formation A, B.

If data from gamma sensor 22 reflects the presence of drill bit 12 or RSS 16 within target zone 30, then the multiplier selected will be 0 and no inclination change will be applied by RSS 16.

However, if data from gamma sensor 22 indicates that drill bit 12 has strayed above target zone 30 into the center region 33 of Formation A, then the PID portion of downhole tool 10 will direct a steering correction by RSS. Since center region 33 corresponds to a multiplier value of −2, the predetermined angular correction value will be multiplied by −2 to provide the course correction value, i.e. the gamma target inclination correction value. Generally, the angular correction value will be predetermined prior to initiating drilling operations; however, the angular correction value may be changed to another stored angular correction valve by downlinking instructions from the surface to downhole tool 10. For the purposes of this discussion, assume that the predetermined angular correction value is 0.15°. Multiplying 0.15° by −2 provides a gamma target inclination correction value of −0.30°, i.e. an inclination correction downward by 0.30° from the current direction.

Similarly, if data from gamma sensor 22 indicates that drill bit 12 has strayed below target zone 30 into the top region 32 of Formation B, then the PID portion of downhole tool 10 will direct a steering correction by RSS by selecting a multiplier of 1 and applying that value to the predetermined angular correction value. If the predetermined angular correction value is 0.25°, then the PID will direct the RSS to steer an upward angle of 0.25° above the current inclination value.

Thus, for completeness, if gamma sensor data indicates that drill bit 12 or RSS 16 is at or below Formation B bottom 36, the multiplier value is 3. If gamma sensor data indicates that drill bit 12 or RSS 16 is at Formation B center 34 and above bottom 36, the multiplier value is 2. If gamma sensor data indicates that drill bit 12 or RSS 16 is at or below Formation B top 32 and above center 34, the multiplier value is 1. If gamma sensor data indicates that drill bit 12 or RSS 16 is at or above Formation A bottom 31 and below center 33, the multiplier value is −1. If gamma sensor data indicates that drill bit 12 or RSS 16 is at Formation A center 33 and below top 35, the multiplier is −2. If gamma sensor data indicates that drill bit 12 or RSS is at or above Formation A top 35, the multiplier is −3.

Even more accurate adjustments in inclination may be achieved when using an azimuthal gamma sensor 22 in the foregoing method. As known to those skilled in the art, gamma values throughout the formation are generally determined during vertical drilling operations or through use of another offset vertical borehole. Azimuthal gamma sensor 22 allows one to monitor incoming gamma counts from various orientations while the tool is rotating while drilling the lateral borehole. While using azimuthal gamma sensor 22, the gamma counts can be determined for each of Formations A and B above and below the tool. During drilling of the vertical borehole or offset well, the tool passes through Formation A and Formation B measures and records the corresponding gamma reading for each location bottom 31, center 33, top 35, top 32, center 34 and bottom 36 in the PID. Using the known gamma counts for each location and the known orientation of azimuthal gamma sensor 22, the multiplier values assigned to the predetermined locations in each Formation can be used to derive a more accurate multiplier value during horizontal drilling operations based on the actual location of drill bit 12 or RSS 16 within Formation A, Formation B or target zone 30 as determined by the monitored gamma count. Use of the corrected multiplier value in conjunction with the predetermined angular correction value provides a more accurate gamma target inclination correction value and will reduce the time required to return drill bit 12 or RSS 16 to target zone 30.

Formula A provides the ability to generate a corrected multiplier value when drill bit 12 or RSS 16 is located above target zone 30. Formula A is defined as follows:

$$\text{Corrected M.V.} = A-(B-C)/(D-C) \qquad \text{FORMULA A}$$

Where:

A=multiplier value just below drill bit location, if drill bit or RSS is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35.

Formula B provides the ability to generate a corrected multiplier value when drill bit 12 or RSS 16 is located below target zone 30. Formula B is defined as follows:

$$\text{Corrected M.V.} = A-(B-D)/(D-C) \qquad \text{FORMULA B}$$

Where:

A=multiplier value just above drill bit location, if drill bit or RSS is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35.

In each formula, the location of the RSS 16 may be substituted for drill bit 12. Additionally, if the actual location of drill bit 12 or RSS 16 is above Formation A top 35 or below Formation B bottom 36, then the PID will revert to the original multiplier value, i.e. −3 if above Formation A top 35 and 3 if below Formation B bottom 36. Likewise, if the actual location of drill bit 12 or RSS 16 is above Formation B top 32 or below Formation A bottom 31, then the PID will use the original target inclination value, i.e. multiplier value of 0 if below Formation A bottom 31 or above Formation B top 32. Of course, as discussed above, gamma sensor 22 continuously monitors gamma radiation, i.e. counts, to determine the relative location of drill bit 12 or RSS 16. The continuous monitoring of gamma radiation permits adjustment of the inclination angle at time intervals of about every ten seconds to about every thirty seconds, more preferably every 15 seconds to every 25 seconds.

For the purposes of this example, assume that target zone 30 has a gamma count value of 40 and Formation A has a gamma count value at top 35 of 80 and a gamma count value of 70 at center 33 and a gamma count value of 60 at bottom 31. Thus, when drill bit 12 or RSS 16 is located above target zone 30 and within Formation A, the measured gamma count value provided by azimuthal gamma sensor 22 to the PID, or other onboard programmable circuitry, can be used to adjust the multiplier value associated with top 35, center 33 and bottom 31 for the actual location of drill bit 12 or RSS 16. For the purposes of this example, when using Formula A, if the value of B is from 60 to 69, then A will be −1; if the value of B is from 70 to 79, then A will be −2; and, if the value of B is 80 or greater, then A will be −3. In this example, the measured gamma count value is 73 and the known orientation of gamma sensor 22 indicates that the value originates in Formation A. Thus, then the PID will recognize that the drill bit 12 or RSS 16 is located between top 35 and center 33. The PID will then adjust the multiplier value to correspond to the actual location of drill bit 12 or RSS 16. One can determine the adjusted, i.e. corrected, multiplier value to be used with the angular correction value by using Formula A. In this instance, the corrected multiplier value (M.V.) is −2.3 [M.V.=−2−(73−70)/(80−70)]. Thus, −2.3 will be multiplied by the predetermined angular correction value to provide the gamma target inclination correction value.

For the purposes of this example where the tool 10 is below the target zone 30 which has a gamma count value of 40, and Formation B has a gamma count value at top 32 of 50 and a gamma count value of 70 at center 34 and a gamma count value of 90 at bottom 36. Thus, when drill bit 12 or RSS 16 is located below target zone 30 and within Formation B, the measured gamma count value provided by azimuthal gamma sensor 22 to the PID, or other onboard programmable circuitry, can be used to adjust the multiplier value associated with bottom 36, center 34 and top 32 for the actual location of drill bit 12 or RSS 16. For the purposes of this example, when using Formula B, if the value of B is from 50 to 69, then A will be 1; if the value of B is from 70 to 89, then A will be 2; and, if the value of B is 90 or greater, then A will be 3. In this example, the measured gamma count value is 78 and the known orientation of gamma sensor 22 indicates that the value originates in Formation B. Thus, the PID will recognize that the drill bit 12 or RSS 16 is located between center 34 and bottom 36. The PID will then adjust the multiplier value to correspond to the actual location of drill bit 12 or RSS 16. One can determine the adjusted, i.e. corrected, multiplier value to be used with the angular correction value by using Formula B. In this instance, the corrected multiplier value (M.V.) will be interpolated as 2.4 [M.V.=2−(78−70)/(70−90)]. Thus, 2.4 will be multiplied by the predetermined angular correction value to provide the gamma target inclination correction value.

In most cases, the PID portion of downhole tool 10 operates in an automated closed loop steering control mode. However, the operator may elect to change the currently selected stored angular correction to another stored angular correction value for use in the automated mode. In general, changes in the currently selected stored angular correction value will require a signal from the surface, called downlinking, to effect the change. Methods for downlinking to the downhole tool 10 and components thereof are well known. For example, mud pulse signals and changes in RPM are commonly used to downlink. A conventional signal may be used to change the angular correction value from the original preprogrammed value to an alternative preprogrammed value. For example, if the original angular correction value is 0.15° but a greater angular change is required than that determined by the multiplier, then a signal may be transmitted directing the selection of an alternative angular correction value of 0.25°.

Other embodiments of the present invention will be apparent to one skilled in the art. As such, the foregoing description merely enables and describes the general uses and methods of the present invention. Accordingly, the following claims define the true scope of the present invention.

What is claimed is:

1. A method for drilling a lateral borehole comprising:

drilling a first borehole from a surface and identifying a target zone for a lateral borehole;

initiating drilling of said lateral borehole within said target zone by placing a downhole tool within said first borehole and drilling said lateral borehole at a first angular inclination direction;

said downhole tool comprising a drill bit carried by a bit box, a steering system secured directly or indirectly to said bit box and a gamma sensor, said steering system including a memory system pre-programmed with a plurality of angular correction values and pre-programmed with a plurality of multiplier values;

selecting a first angular correction value from the plurality of pre-programmed angular correction values;

using said gamma sensor to obtain gamma radiation values, evaluate the gamma radiation in an area of said target zone;

using the gamma radiation values, identify a first formation above the target zone, said first formation above the target zone having a first bottom, a first center and first top and identify a second formation below the target zone, said second formation having a second bottom, a second center and a second top;

associate a different one of said multiplier values with each of said target zone, first bottom, first center, first top, second bottom, second center and second top;

monitoring a location of the drill bit or the steering system during drilling operations using the gamma sensor and determining a monitored position of the drill bit or the steering system;

identify the location of the drill bit or the steering system as one of the target zone, first bottom, first center, first top, second bottom, second center and second top;

determining a gamma target inclination correction value using the identified location of the drill bit or the steering system wherein a gamma target inclination correction value is a product of the first angular correction value and the multiplier value associated with the identified location of the drill bit or steering system;

continue drilling said lateral borehole by applying the gamma target inclination correction value to the first angular inclination direction of the drill bit or steering system or to a current angular inclination direction of the drill bit or steering system;

wherein the pre-programmed multiplier value for the target zone is zero, the pre-programmed multiplier value for the first bottom is −1, the pre-programmed multiplier value for the first center is −2, the pre-programmed multiplier value for the first top is −3, the pre-programmed multiplier value for the second bottom is 3, the pre-programmed multiplier value for the second center is 2, and the pre-programmed multiplier value for the second top is 1; and wherein when said steering system is located at or below the second bottom and the gamma target inclination correction value is the product of a first angular correction value and a pre-programmed multiplier value of 3 for the second bottom.

2. The method of claim 1, wherein said gamma sensor is located between said drill bit and about ten feet from said drill bit.

3. The method of claim 1, further comprising:

determining a gamma count value for each of said first bottom, first center, first top, second bottom, second center, and second top;

when the monitored position of the drill bit or steering system is in the first formation providing a corrected multiplier value using Formula A, wherein the gamma target inclination correction value is the product of the first angular correction value and the corrected multiplier value, where Formula A is defined as follows:

$$\text{Corrected M.V.}=A-(B-C)/(D-C) \qquad \text{FORMULA A}$$

Where:

A=multiplier value just below drill bit location, if drill bit is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35;

when the monitored position of the drill bit or system steering system is in the second formation providing a corrected multiplier value using Formula B and wherein the gamma target inclination correction value is the product of the first angular correction value and the corrected multiplier value, where Formula B is defined as follows:

$$\text{Corrected M.V.}=A-(B-D)/(D-C) \qquad \text{FORMULA B}$$

Where:

A=multiplier value just above drill bit location, if drill bit is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35.

4. The method of claim 3, wherein the pre-programmed angular correction values are 0.15°, 0.25°, 0.5° and 0.75°.

5. The method of claim 1, wherein when said steering system is located at the second center and above the second bottom the gamma target inclination correction value is the product of first angular correction value and the pre-programmed multiplier value of 2 for the second center.

6. The method of claim 1, wherein when said steering system is located at the second top and above the second center the gamma target inclination correction value is the product of first angular correction value and the pre-programmed multiplier value of 1 for the second top.

7. The method of claim 1, wherein when said steering system is located at the first bottom and below the first center the gamma target inclination correction value is the product of first angular correction value and the pre-programmed multiplier value of −1 for the first bottom.

8. The method of claim 1, wherein when said steering system is located at the first center and below the first top the gamma target inclination correction value is the product of first angular correction value and the pre-programmed multiplier value of −2 for the first center.

9. The method of claim 1, wherein when said steering system is located at or above the first top the gamma target inclination correction value is the product of first angular correction value and the pre-programmed multiplier value of −3 for the first top.

10. The method of claim 1, wherein when said steering system is located in the target zone the gamma target inclination correction value is the product of first angular correction value and the pre-programmed multiplier value of 0.

11. The method of claim 1, wherein said steering system is a rotary steerable system.

12. A method for drilling a lateral borehole comprising:

drilling a first borehole from a surface and identifying a target zone for a lateral borehole;

initiating drilling of said lateral borehole within said target zone by placing a downhole tool within said first borehole and drilling said lateral borehole at a first angular inclination direction;

said downhole tool comprising a drill bit carried by a bit box, a steering system and a gamma sensor, said steering system including a memory system pre-programmed with a plurality of angular correction values and pre-programmed with a plurality of different multiplier values for the target zone, a plurality of locations above the target zone and a plurality of locations below the target zone;

selecting a first angular correction value from the plurality of pre-programmed angular correction values;

using said gamma sensor to obtain gamma radiation values, evaluate the gamma radiation in an area of said target zone;

using the gamma radiation values, identify a first formation above the target zone, said first formation above the target zone having a first bottom and first top and identify a second formation below the target zone, the second formation having a second bottom and a second top;

associate one of said multiplier values with each of said target zone, first bottom, first top, second bottom and second top;

monitoring a location of the drill bit or the steering system during drilling operations using the gamma sensor;

identify the location of the drill bit or the steering system as one of the target zone, first bottom, first top, second bottom and second top;

determining a gamma target inclination correction value using the identified location of the drill bit or the steering system wherein the gamma target inclination correction value is a product of the first angular correction value and the multiplier value associated with the identified location of the drill bit or steering system;

continue drilling said lateral borehole by applying the gamma target inclination correction value to the first angular inclination direction of the drill bit or steering system or to a current angular inclination direction of the drill bit or steering system; and wherein said steering system is located at or above the first top and the gamma target inclination correction value is the product of an angular correction value and one of the plurality of pre-programmed multiplier values associated with a steering system location.

13. The method of claim 12, wherein the pre-programmed multiplier value for the target zone is zero, the pre-programmed multiplier value for the first bottom is −1, the pre-programmed multiplier value for the first top is −2, the pre-programmed multiplier value for the second bottom is 2, and the pre-programmed multiplier value for the second top is 1.

14. The method of claim 13, further comprising:

determining a gamma count value for each of said first bottom, first center, first top, second bottom, second center, second top;

when a monitored position of the drill bit or steering system is in the first formation providing a corrected multiplier value using Formula A, wherein the gamma target inclination correction value is the product of the first angular correction value and the corrected multiplier value, where Formula A is defined as follows:

$$\text{Corrected M.V.}=A-(B-C)/(D-C) \qquad \text{FORMULA A}$$

Where:

A=multiplier value just below drill bit location, if drill bit is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35;

when the monitored position of the drill bit or system steering system is in the second formation providing a corrected multiplier value using Formula B and wherein the gamma target inclination correction value is the product of the first angular correction value and the corrected multiplier value, where Formula B is defined as follows:

$$\text{Corrected M.V.}=A-(B-D)/(D-C) \qquad \text{FORMULA B}$$

Where:

A=multiplier value just above drill bit location, if drill bit is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35.

15. The method of claim 12, wherein the pre-programmed multiplier value for the target zone is zero, the pre-programmed multiplier value for the first bottom is −1, the pre-programmed multiplier value for the first top is −3, the pre-programmed multiplier value for the second bottom is 3, and the pre-programmed multiplier value for the second top is 1.

16. The method of claim 15, further comprising:

determining a gamma count value for each of said first bottom, first center, first top, second bottom, second center, second top;

when a monitored position of the drill bit or steering system is in the first formation providing a corrected multiplier value using Formula A, wherein the gamma target inclination correction value is the product of the first angular correction value and the corrected multiplier value, where Formula A is defined as follows:

$$\text{Corrected M.V.}=A-(B-C)/(D-C) \qquad \text{FORMULA A}$$

Where:

A=multiplier value just below drill bit location, if drill bit is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35;

when the monitored position of the drill bit or system steering system is in the second formation providing a corrected multiplier value using Formula B and wherein the gamma target inclination correction value is the product of the first angular correction value and the corrected multiplier value, where Formula B is defined as follows:

$$\text{Corrected M.V.}=A-(B-D)/(D-C) \qquad \text{FORMULA B}$$

Where:

A=multiplier value just above drill bit location, if drill bit is at an identified level use the multiplier value for that level B=gamma count at location of drill bit C=predetermined gamma count value for location immediately below B, i.e. bottom 31 or center 33

D=predetermined gamma count for location immediately above B, i.e. center 33 or top 35.

17. The method of claim 12, wherein said steering system is a rotary steerable system.

* * * * *